US006601254B1

(12) United States Patent
Walz

(10) Patent No.: US 6,601,254 B1
(45) Date of Patent: Aug. 5, 2003

(54) TOOL ADAPTER AND METHOD

(76) Inventor: Matthias Walz, Watzlhof 55, Grafenweisen 93479 (DE)

( * ) Notice: Subject to any disclaimer, the term of this patent is extended or adjusted under 35 U.S.C. 154(b) by 131 days.

(21) Appl. No.: 10/007,218

(22) Filed: Nov. 10, 2001

(51) Int. Cl.[7] ..... B25B 7/22

(52) U.S. Cl. ..... 7/128; 7/138; 81/180.1; 81/184

(58) Field of Search ..... 7/125, 127, 128, 7/138, 165, 167, 168, 170; 81/180.1, 184, 177.2

(56) References Cited

U.S. PATENT DOCUMENTS

| | | | | |
|---|---|---|---|---|
| 4,744,272 | A | 5/1988 | Leatherman | |
| 5,809,600 | A | 9/1998 | Cachot | 7/128 |
| 6,000,080 | A | 12/1999 | Anderson et al. | 7/128 |
| 6,145,851 | A | 11/2000 | Heber | 7/165 |
| 6,182,540 | B1 | 2/2001 | Wang | 7/138 |

*Primary Examiner*—Eileen P. Morgan
*Assistant Examiner*—Joni B. Danganan
(74) *Attorney, Agent, or Firm*—Eric Karich

(57) ABSTRACT

A combination includes a foldable hand tool, an adapter, and an implement. The foldable hand tool provides a pair of handles that are connected with a pin to a pair of pivotally engaged gripping jaws. The implement includes a tool head, such as a ratchet wrench or screw driver, and a male adapter engagement portion. The adapter includes a female tool engagement chamber for receiving the implement; and the adapter includes a pair of spaced apart sidewalls extending from the female tool engagement chamber. An interior surface of each of the sidewalls has a generally U-shaped depression on the interior surface of each of the sidewalls, each of the depressions being shaped to firmly engage one of the pins in the foldable hand tool. Once it has been assembled, the foldable hand tool is connected to the implement through the adapter. The foldable hand tool thereby provides leverage through the handle to manipulate the tool head of the implement.

4 Claims, 4 Drawing Sheets

TOOL ADAPTER AND METHOD

BACKGROUND OF THE INVENTION

Field of the Invention

This invention relates generally to a hand tool, and more particularly to a foldable hand tool and an adapter, the adapter allowing the use of a plurality of different tool heads.

Description of Related Art

The folding gripping tool described in Leatherman, U.S. Pat. No. 4,744,272 has been widely adopted by the public because it provides a variety of handy tools in a compact folding handle arrangement. Unfortunately, the Leatherman tool does not provide several tools that are routinely needed by people using the tool. The prior art does not teach an adapter for use with the Leatherman tool that allows the use of a plurality of different tool heads.

The prior art teaches a folding gripping tool that provides a variety of handy tools in a compact folding handle arrangement. However, the prior art does not teach an adapter that allows the Leatherman tool to be used as an even greater number of tools. The present invention fulfills these needs and provides further related advantages as described in the following summary.

SUMMARY OF THE INVENTION

The present invention teaches certain benefits in construction and use which give rise to the objectives described below.

The present invention provides a combination including a foldable hand tool, an adapter, and an implement. The foldable hand tool provides a pair of handles that are connected with a pin to a pair of pivotally engaged gripping jaws. The implement is a tool head, such as a ratchet wrench or screw driver, having a adapter engagement means. The adapter includes a tool engagement means and an implement locking means. The pins of the foldable hand tool are connected to the tool engagement means of the adapter; and the adapter engagement means of the implement is connected to the implement locking means of the adapter. Once it has been assembled, the foldable hand tool is connected to the implement through the adapter. The foldable hand tool thereby provides leverage through the handle to manipulate the tool head of the implement.

A primary objective of the present invention is to provide a combination foldable hand tool, adapter, and implement having advantages not taught by the prior art.

Another objective is to allow a user to carry a great number of tools in a small container or pouch, all of the tools being usable upon connection of the tool to a foldable hand tool through an adapter.

A further objective is to save the user money in allowing him to purchase small tool heads rather than the full-size version of each of the tools.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a combination including a foldable hand tool 10, an adapter 30, and an implement 40.

Figure 1:
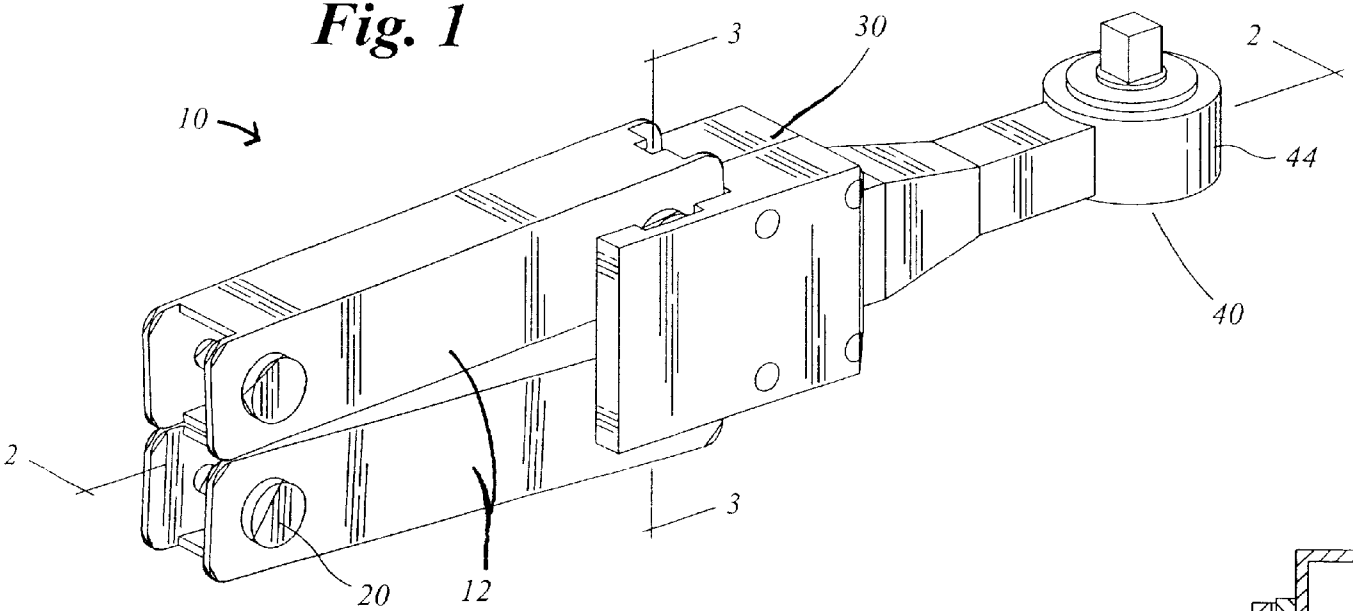
FIG. 1 is a perspective view of the preferred embodiment of the present invention.

As shown in FIG. 1, the foldable hand tool 10 is connected to the implement 40 through the adapter 30. The foldable hand tool 10 provides leverage through a pair of handles 12 to manipulate the implement 40. The adapter 30 thereby facilitates the use of the implement 40 in conjunction with the foldable hand tool 10.

Figure 4:
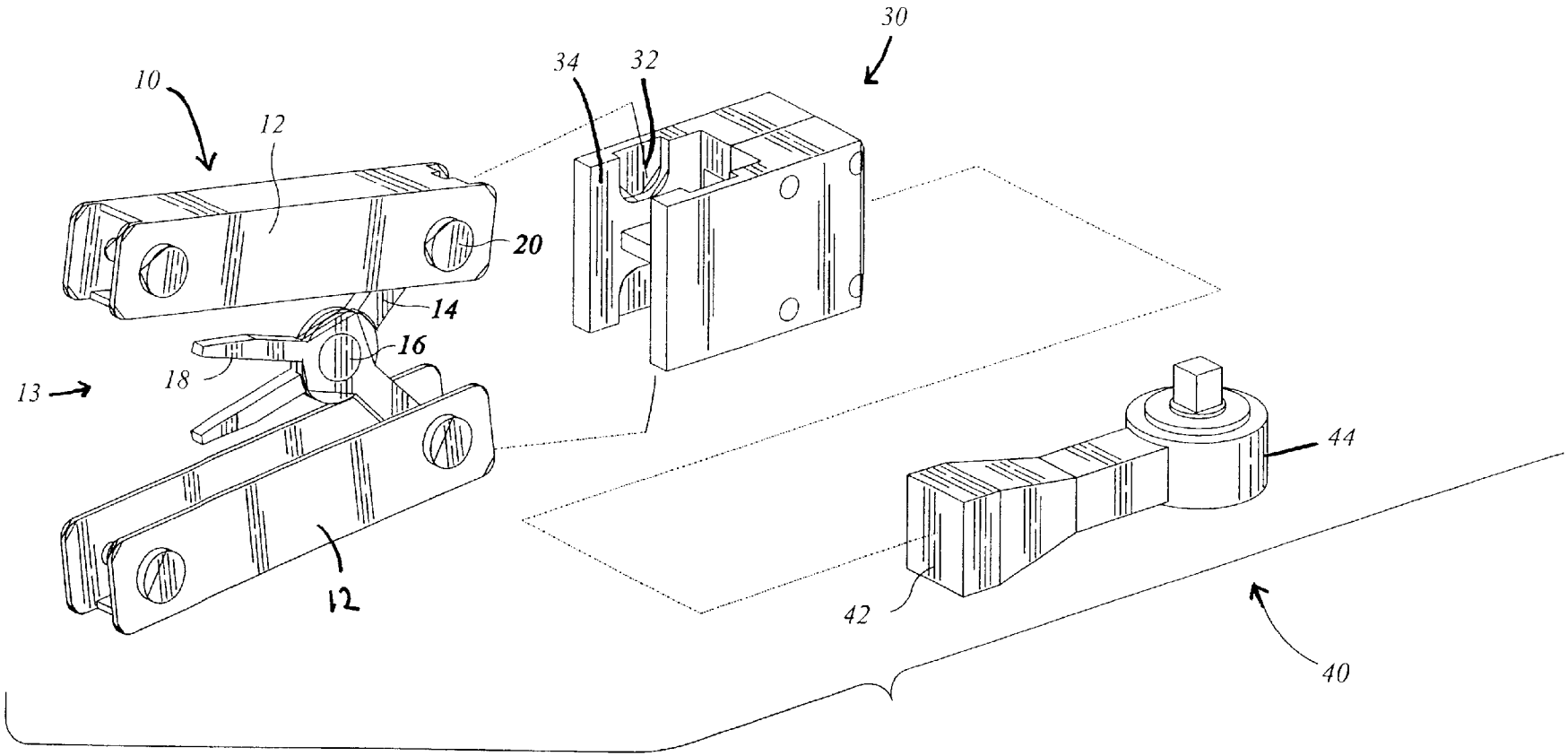
FIG. 4 is an exploded perspective view thereof.

As shown in FIG. 4, the foldable hand tool 10 has a pair of elongate gripping jaws 13 operably connected to a pair of elongate handles 12. Each of the jaws 13 includes a gripping portion 18 and a tang 14. The jaws 13 are pivotally connected to each other with a pivot 16 located between the gripping portion 18 and the tang 14. The handles 12 are preferably shaped to enclose the gripping jaws 13 when the foldable hand tool 10 is in its folded configuration.

Each of the handles 12 is pivotally connected to the tang 14 of one of the gripping jaws 13 with a pin 20. The foldable hand tool 10 is preferably the tool described in Leatherman, U.S. Pat. No. 4,744,272, hereby incorporated by reference in full. The handles 12 preferably include a pin 20 at both ends of the handles 12, as shown in FIG. 1, thereby allowing the adapter 30 to be attached at either end of the foldable hand tool 10. The foldable hand tool 10 is preferably made of a strong, hard, and durable material such as steel.

Figure 3:
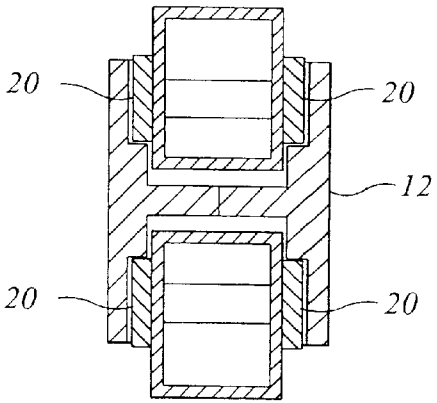
FIG. 3 is a sectional view thereof taken along line 3—3 in FIG. 1.
Figure 2:
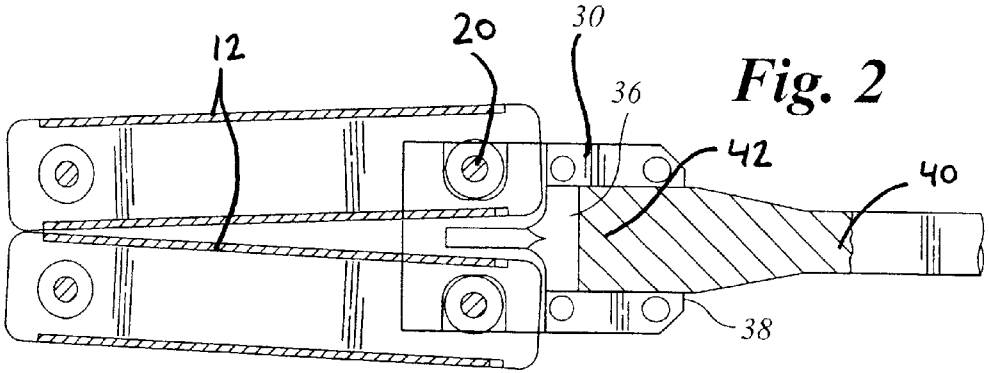
FIG. 2 is a sectional view thereof taken along line 2—2 in FIG. 1, excluding the gripping jaws for the sake of clarity.
Figure 6:
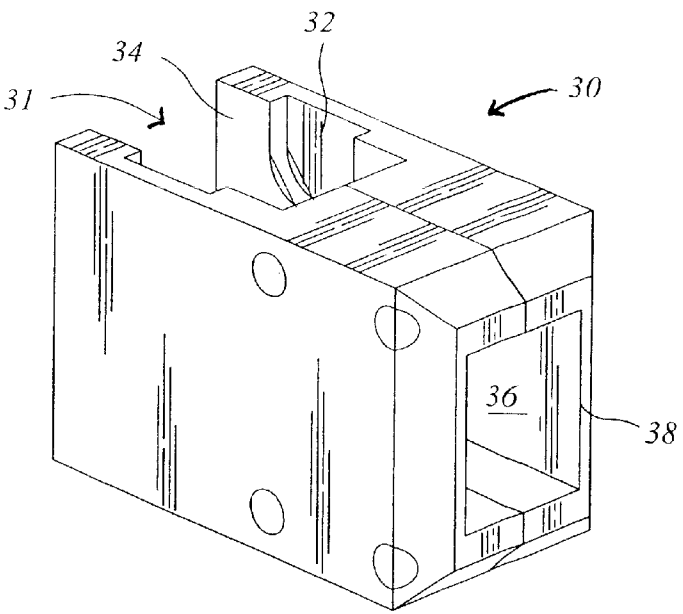
FIG. 6 is a perspective view of the adapter.
Figure 5:
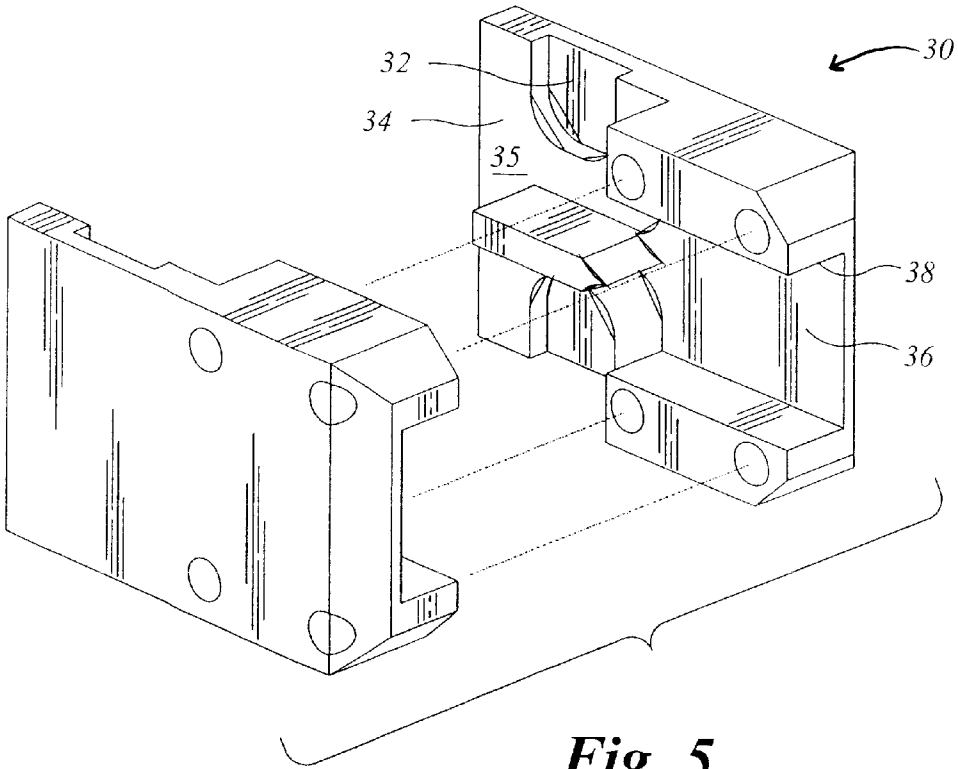
FIG. 5 is an exploded perspective view of the adapter showing the adapter separated into two pieces.
Figure 7:
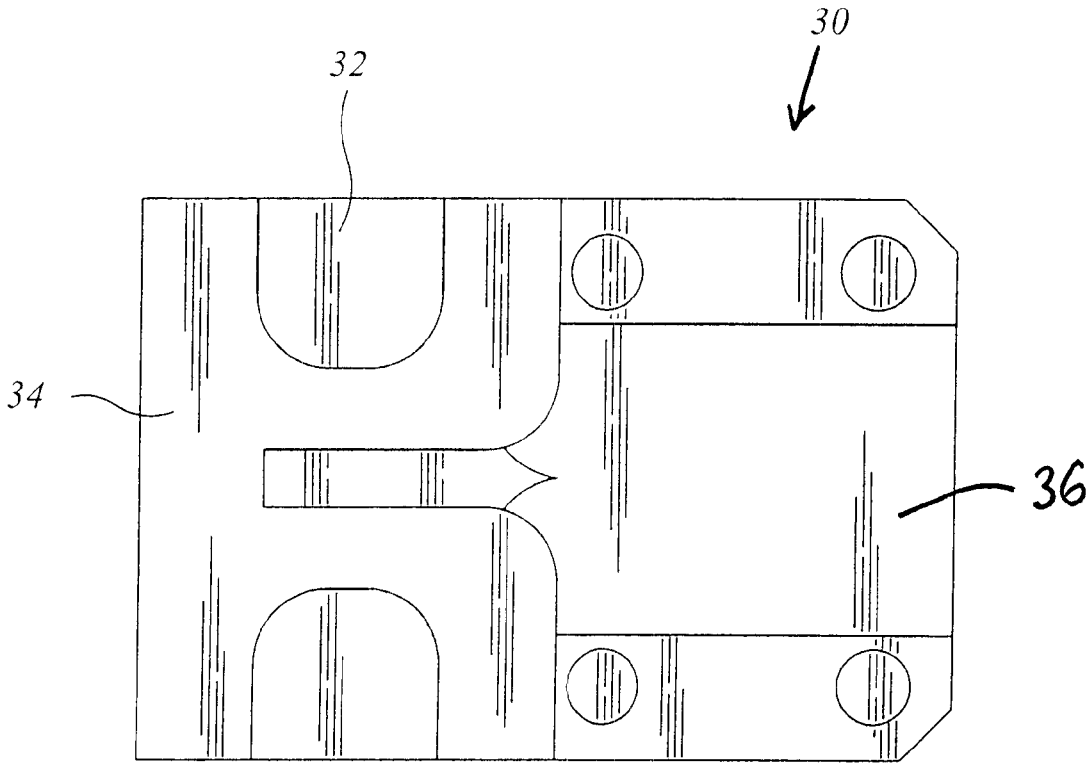
FIG. 7 is a top plan view of one piece of the adapter.
Figure 8:
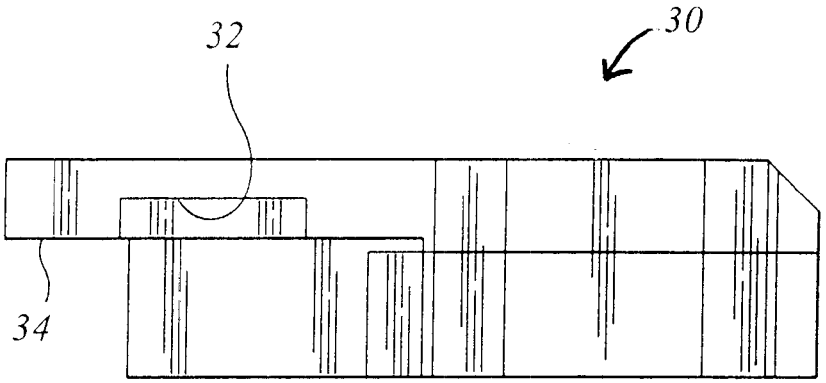
FIG. 8 is a side elevational view of one piece of the adapter.

As shown in FIGS. 1–4, the adapter 30 is designed to removably engage the implement 40 to the foldable hand tool 10. As shown in FIGS. 2 and 5–7, the adapter 30 has an implement locking means 36 and a tool engagement means 31 for removably engaging the pins 20 of the handles 12. As shown in FIGS. 5 and 6, the implement locking means 36 is preferably a chamber shaped to receive a portion of the implement through an aperture 38. The tool engagement means 31 is preferably a pair of spaced apart sidewalls 34 extending from the implement locking means 36. An interior surface 35 of each of the sidewalls 34 has a locking means 32 for removably locking the adapter to pins 20 of the handles 12. As shown in FIGS. 2, 3, and 4, the locking means 32 is preferably a generally U-shaped depression on the interior surface 35 of each of the sidewalls 34, the depression 32 being shaped to firmly engage its respective pin 20. The adapter 30 is made of a rigid and durable material, preferably steel. It is preferably made of two pieces, as shown in FIG. 5, although this is not important to the inventive nature of the invention.

As shown in FIGS. 1, 2, and 4, the implement 40 has a tool head 44 and an adapter engagement means 42. The tool head 44 can be adapted to function as the operative portion of any tool. In FIG. 1, the tool head 44 is a ratchet wrench. The invention is not limited to this form of tool head 44, however, and almost any tool can be adapted, including but not limited to all manner of wrenches, screw-drivers, hammers and chisels. The adapter engagement means 42 is adapted to cooperate with the implement locking means 36 to removably secure the implement 40 to the adapter 30. In its preferred embodiment, as shown in FIGS. 2 and 6, the adapter engagement means 42 is a square male portion that slides snugly into a square female portion of the implement locking means 36; however, alternative shapes and features can be devised by those skilled in the art, and these alternatives should be considered within the scope of the claimed invention. The implement 40 is preferably constructed from a durable material such as steel.

The invention further includes a method for removably engaging an implement 40 to a foldable hand tool 10. The method first includes providing a foldable hand tool 10, an adapter 30 and an implement 40 as described above. As shown in FIGS. 1 and 2, the implement 40 is attached to the adapter 30 by sliding the adapter engagement means 42 of the implement 40 into the implement locking means 36 of the adapter 30. The adapter 30 is then attached to the foldable hand tool 10 by locking the pins 20 of the handles 12 into the tool engagement means 31 of the adapter 30. Once these elements are assembled, the user can hold the handles 12 of the foldable hand tool 10 to position the tool head 44 for use; and the user can move the handles 12 to operatively manipulate the tool head 44. The handles 12 provide leverage for use of the tool head 44. The advantage to this configuration is that the user only needs to carry the foldable hand tool 10, the adapter 30, and a plurality of implements 40 having different tool heads 44. Since the operable tool heads 44 are quite small, a user can easily carry an entire bag of different tools and simply snap them onto the foldable hand tool 10 for use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An adapter for removably engaging an implement to a foldable hand tool, the foldable hand tool having a pair of handles, each handle having a pin, the adapter comprising:

an implement locking means shaped for removably engaging the implement; and a pair of spaced apart sidewalls extending from the implement locking means, an interior surface of each of the sidewalls having a locking means for removably locking the adapter to the pins.

2. The adapter of claim 1 wherein the locking means for removably locking the adapter to pins is a generally U-shaped depression on the interior surface of each of the sidewalls, each of the depressions being shaped to firmly engage its respective pin.

3. A combination foldable hand tool, adapter, and implement, the combination comprising:

a foldable hand tool having a pair of elongate gripping jaws, each of the jaws including a gripping portion and a tang, the jaws being pivotally connected to each other with a pivot located between the gripping portion and the tang; and a pair of elongate handles, each of the handles being pivotally connected to the tang of one of the gripping jaws with a pin;

an adapter having an implement locking means and a tool engagement means for removably engaging the pins of the handles; and an implement having a tool head and an adapter engagement means adapted to cooperate with the implement locking means to removably secure the implement to the adapter.

4. A method for removably engaging an implement to a foldable hand tool, the method comprising the steps of:

a) providing a foldable hand tool having a pair of elongate gripping jaws, each of the jaws including a gripping portion and a tang, the jaws being pivotally connected to each other with a pivot located between the gripping portion and the tang; and a pair of elongate handles, each of the handles being pivotally connected to the tang of one of the gripping jaws with a pin;

b) providing an adapter having an implement locking means and a tool engagement means for removably engaging the pins of the handles;

c) providing an implement having a tool head and an adapter engagement means adapted to cooperate with the implement locking means to removably secure the implement to the adapter;

d) removably engaging the tool engagement means of the adapter to the pins of the handles;

e) removably engaging the adapter engagement means of the implement to the implement locking means of the adapter;

f) holding the handles of the foldable hand tool to position the tool head for use; and g) moving the handle to operatively manipulate the tool head.

* * * * *